US010360873B2

(12) United States Patent
Wang

(10) Patent No.: US 10,360,873 B2
(45) Date of Patent: Jul. 23, 2019

(54) METHOD AND SYSTEM FOR GENERATING IMAGES ON DISPLAY

(71) Applicant: Shenzhen China Star Optoelectronics Technology Co., Ltd., Shenzhen, Guangdong (CN)

(72) Inventor: Yanxue Wang, Guangdong (CN)

(73) Assignee: Shenzhen China Star Optoelectronics Technology Co., Ltd, Shenzhen (CN)

( * ) Notice: Subject to any disclaimer, the term of this patent is extended or adjusted under 35 U.S.C. 154(b) by 177 days.

(21) Appl. No.: 15/528,737

(22) PCT Filed: Apr. 20, 2017

(86) PCT No.: PCT/CN2017/081209
§ 371 (c)(1),
(2) Date: May 22, 2017

(87) PCT Pub. No.: WO2018/176530
PCT Pub. Date: Oct. 4, 2018

(65) Prior Publication Data

US 2019/0096362 A1 Mar. 28, 2019

(30) Foreign Application Priority Data

Mar. 30, 2017 (CN) ..... 2017 1 0201897

(51) Int. Cl.
*G09G 5/00* (2006.01)
*G09G 5/02* (2006.01)

(52) U.S. Cl.
CPC ..... *G09G 5/028* (2013.01); *G09G 5/026* (2013.01); *G09G 2320/0666* (2013.01); *G09G 2320/0673* (2013.01)

(58) Field of Classification Search
CPC ..... G09G 5/028; G09G 5/026; G09G 2320/0666; G09G 2320/0673
(Continued)

(56) References Cited

U.S. PATENT DOCUMENTS 5,416,890 A * 5/1995 Beretta ..... G06F 3/04845 345/440
H001506 H * 12/1995 Beretta ..... 349/549
(Continued)

FOREIGN PATENT DOCUMENTS

CN 1940695 A 4/2007
CN 104021746 A 9/2014
(Continued)

*Primary Examiner* — Sarah Lhymn
(74) *Attorney, Agent, or Firm* — Andrew C. Cheng

(57) ABSTRACT

The disclosure provides a method for generating images on a display, including: S1, obtaining first Lab values according to LCH values; S2, obtaining a first original value of a measured display; obtaining first tristimulus values of a color n according to tristimulus values of a pure white image as reference values and the first Lab value; S3, obtaining first output gray-scale values according to the first tristimulus values; S4, obtaining first input gray-scale values according to the first output gray-scale values; S5, obtaining second Lab values according to the first input gray-scale values; S6, comparing the first Lab values and the second Lab values. A system of the disclosure includes an obtaining module, a converting module, a judging module, an outputting module and a correcting module. Compared with the prior art, colors in the display image approach the real colors.

8 Claims, 3 Drawing Sheets

(58) Field of Classification Search
USPC ..... 345/581, 604
See application file for complete search history.

(56) References Cited

U.S. PATENT DOCUMENTS

| | | | | | |
|---|---|---|---|---|---|
| 5,687,000 | A * | 11/1997 | Nakaoka | H04N 1/6011 | 358/296 |
| 6,559,982 | B1 | 5/2003 | Gondek | | |
| 7,312,891 | B2 * | 12/2007 | Tsuchiya | G06K 15/02 | 345/601 |
| 7,986,438 | B2 * | 7/2011 | Takahashi | H04N 1/6027 | 348/234 |
| 8,031,203 | B2 * | 10/2011 | Kawashima | H04N 1/603 | 345/549 |
| 8,593,476 | B2 * | 11/2013 | Demos | G01J 3/02 | 345/589 |
| 2007/0030505 | A1 * | 2/2007 | Ito | H04N 1/6019 | 358/1.9 |
| 2009/0002783 | A1 * | 1/2009 | Hashii | H04N 1/6033 | 358/520 |
| 2009/0174725 | A1 * | 7/2009 | Kim | G09G 5/02 | 345/590 |
| 2010/0134694 | A1 | 6/2010 | Sakurai | | |
| 2014/0043371 | A1 * | 2/2014 | Langendijk | G09G 3/3426 | 345/690 |

FOREIGN PATENT DOCUMENTS

| | | | |
|---|---|---|---|
| CN | 104021746 | A | 10/2015 |
| JP | 2008284790 | A | 11/2008 |

* cited by examiner

METHOD AND SYSTEM FOR GENERATING IMAGES ON DISPLAY

TECHNICAL FIELD

The disclosure relates to a display technical field, and more particularly to a method and a system for generating images on a display based on a CIE Lab color system.

DESCRIPTION OF RELATED ART

In the liquid crystal panel industry, colors are generally described by using a CIE1931XYZ color system or a CIE1976LUV color system, which can be further applied in describing view angles and colour difference. The CIELab color system is a better distributed color space compared with the LUV color system, for which most colour difference formulas are based on the CIElab color system to calculate colour difference. With the development of the colour difference formulas (e.g. CIE DE2000), the application of Lab in the display field has been mentioned commonly. The CIE1931 XYZ standard color metric system is regularly utilized to describe colors in the industry, which has the poorer distributed color space compared with the CIElab color system, leading to incorrect in describing chromatic aberration. Although some use the LUV system to define the chromatic aberration, the distribution of the color space is poorer than the LAB system. And the latest chromatic aberration formulas in the industry are mostly provided based on the CIELab color system. With respect to define a pattern, a conventional method in the industry is to define R G B values of the pattern to show on a display, followed by the measurement. But to different displays, properties of screens are various. Same R G B will be different on different panels in the view of an observer. It is a question worthy to be considered that how to measure and adjust colour difference so as to approach the real color.

SUMMARY

In order to overcome shortcomings of the prior art, the disclosure provides a method and a system for generating images on a display, and the colors showed on the display can be approaching to the real colors.

The disclosure provides a method for generating images on a display, including following steps.

Step S1, obtaining LCH values of a color n, obtaining first Lab values by calculation; converting the LCH values of the color n to Lab for obtaining the first Lab values.

Step S2, measuring a measured display by a color analyzer to obtain a first original value of the measured display. The first original value includes tristimulus values of an R, G, B, W four colors full gray-scale (0~255), a gamma value of R, G, B, W four colors, tristimulus values of a pure white image, and chromatic values of pure red, pure green and pure blue; obtaining first tristimulus values of the color n according to the tristimulus values of the pure white image as reference values and the first Lab values; obtaining the first tristimulus values by conversion of the first Lab values.

Step S3, obtaining first output gray-scale values according to the first tristimulus values of the color n, the chromatic values of pure red, pure green and pure blue in the first original value, and the tristimulus values of the pure white image; converting the XYZ values to RGB values to obtain the first output gray-scale values.

Step S4, obtaining first input gray-scale values to be input to the display respectively according to the first output gray-scale values and the gamma value.

Step S5, obtaining second Lab values according to the first input gray-scale values and the tristimulus values of RGB three colors in the first original value.

Step S6, comparing the first Lab values and the second Lab values, when the first Lab values are consistent with the second Lab values, outputting the first input gray-scale values to the measured display for display, which is step S7.

Furthermore, a process of obtaining second Lab values according to the first input gray-scale values and the tristimulus values of RGB three colors in the first original value in the step S5 is achieved by: processing the tristimulus values of RGB three colors by mixing colors; obtaining second tristimulus values of the color n; after obtaining the second tristimulus values of the color n, converting the XYZ values to the Lab values to obtain the second Lab values.

Furthermore, in the step S6, when the first Lab values are inconsistent with the second Lab values, step S8 will be processed, the step S8 is a correction.

Furthermore, the correction includes following steps.

Step S11, obtaining tristimulus values of $R_{1in}$, $G_{1in}$, $B_{1in}$ in the first input gray-scale values according to the first input gray-scale value, subsequently obtaining third tristimulus values of the color n corresponding to the first input gray-scale values by calculation; obtaining the third tristimulus values by conversion of the first input gray-scale values.

Step S12, calculating the third tristimulus values to obtain second output gray-scale values; obtaining the second output gray-scale values by conversion of the third tristimulus values.

Step S13, obtaining second input gray-scale values according to the second output gray-scale values and the gamma value corresponding to the first input gray-scale values, outputting the second input gray-scale values.

Step S14, obtaining third Lab values according to the second input gray-scale values.

Step S15, comparing the third Lab values and the first Lab values, if the third Lab values are consistent with the first values, outputting the second input gray-scale values to the measured display for display, which is step S16.

Furthermore, a process of obtaining third Lab values according to the second input gray-scale values in the step S14 is achieved by: converting the RGB values to the XYZ values to obtain RGB tristimulus values corresponding to the second input gray-scale values after obtaining the second input gray-scale values; obtaining the third Lab values by conversion of the obtained RGB tristimulus values.

Furthermore, in the step S15, when the third Lab values are inconsistent with the first Lab values, step S17 will be processed, the step S17 is a re-correction.

Furthermore, the re-correction includes following steps.

Step S21, respectively processing the second input gray-scale values by ±1~10 simultaneously in sequence to obtain third input gray-scale values, obtaining the RGB tristimulus values corresponding to the third gray-scale value according to the third input gray-scale values after each process; obtaining the third tristimulus values by conversion of the first input gray-scale values.

Step S22, obtaining fourth Lab values according to the RGB tristimulus values; obtaining the fourth Lab values by conversion of the RGB tristimulus values.

Step S23, comparing the fourth Lab values and the first Lab values, if the fourth Lab values are consistent with the first Lab values, outputting the third input gray-scale values to the measured display for display, which is step S24.

Furthermore, in the step S23, the fourth Lab values and the first Lab values are compared, if the fourth Lab values are inconsistent with the first Lab values, the step S21 will be re-processed, the step S21 to the step S23 will be repeated until the fourth Lab values and the first Lab values are consistent.

The disclosure further provides a system for generating images on a display. The system includes an obtaining module, a converting module, a judging module, an outputting module and a correcting module.

The obtaining module is configured to obtain LCH values of a color n and obtain a first original value of a measured display, further sending the first original value to the converting module for conversion.

The converting module is configured to convert the LCH values of the color n to first Lab values according to the first original value; as well as processing conversion among XYZ values, RGB values, Lab values and a gray-scale value according to the first Lab values and the first original value.

The judging module is configured to compare the Lab values and the first Lab values. If the Lab values are consistent with the first Lab values, an output command will be sent to the outputting module. If the Lab values are inconsistent with the first Lab values, a correction command will be sent to the correcting module.

The outputting module is configured to output the corresponding gray-scale value to the measured display after receiving the output command.

The correcting module is configured to correct the gray-scale value once after receiving the correction command, and send the corrected gray-scale value to the converting module.

Furthermore, the correcting module is further configured to re-correct the gray-scale value, and send the corrected gray-scale value to the converting module.

Compared with the prior art, the disclosure is based on the CIE Lab color system. The Lab values thereof can be obtained by calculation of lightness (L), hue (H) and color (C) of a given color, and the XYZ values of the color can further be obtained by calculation. The display image of the color is achieved according to the gamma characteristic value of the display and parameters such as R, G, B chromatic values. Appropriateness of the Lab values of the generated display image is judged, if it is inappropriate, the gamma parameter will be corrected to adjust the display image until the proper image is generated, which provides convenience to measurement application of chromatic aberration of the CIELab color system, and the colors in the display image are approaching the real colors.

DETAILED DESCRIPTION OF PREFERRED EMBODIMENTS

The disclosure will be described in detail with reference to embodiments and the accompanying drawings as follows.

As the disclosure is achieved based on a CIELab color system, RGB below represents RGB values of a CIE1931 color system, and XYZ values are the XYZ values of a CIE1931-XYZ standard color system.

Figure 1:
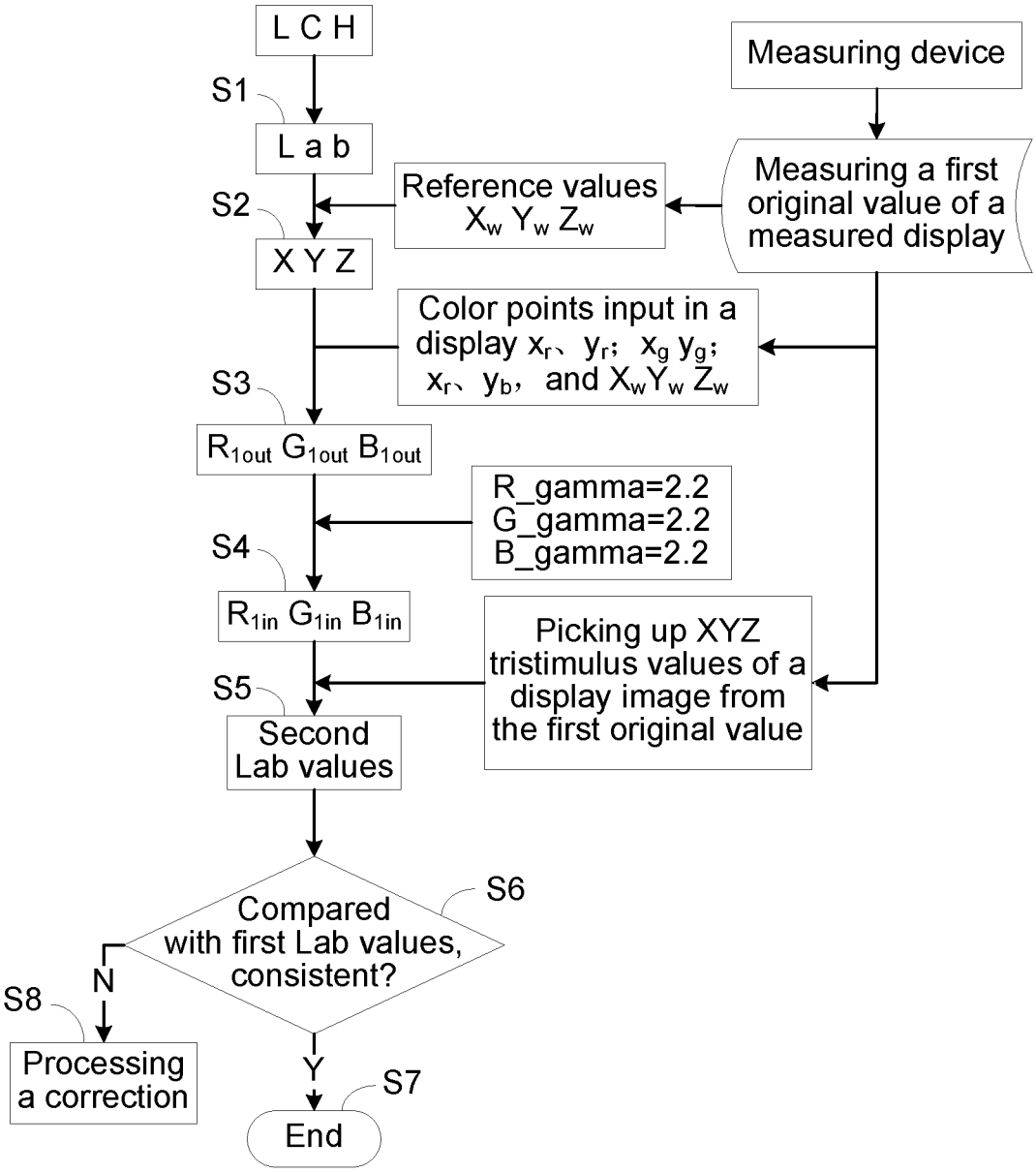
FIG. 1 is a flowchart of a method for generating images on a display according to the disclosure.

As shown in FIG. 1, a method for generating images on a display of the disclosure includes following steps.

Step S1, obtaining LCH values (values of lightness (L), hue (H) and color (C)) of a color n, obtaining first Lab values by calculation.

Converting the LCH values of the color n to the first Lab values is achieved by calculation according to following formulas:

$$L=L;$$

$$a=C\cos(H);$$

$$b=C\sin(H);$$

The first Lab values can be obtained according to the formulas above.

Step S2, measuring a measured display by a color analyzer to obtain a first original value of the measured display. The first original value includes tristimulus values of an R, G, B, W four colors full gray-scale (0~255), a gamma value of R, G, B, W four colors, tristimulus values of a pure white image ($X_w$, $Y_w$, $Z_w$), and chromatic values of pure red, pure green and pure blue ($x_r$, $x_g$, $x_b$; $y_r$, $y_g$, $Y_b$); obtaining first tristimulus values of the color n ($X_{1n}$, $Y_{1n}$, $Z_{1n}$) according to the tristimulus values of the pure white image as reference values and the first Lab values.

The process of obtaining first tristimulus values of the color n ($X_{1n}$, $Y_{1n}$, $Z_{1n}$) according to the tristimulus values of the pure white image and the first Lab values is achieved by converting the first Lab values to the XYZ values, specifically as follows:

$$X_n=\begin{cases} X_w*f_x^3 & f_x>0.2069 \\ X_w*(f_x-0.1379)*0.1284 & \text{otherwise} \end{cases}$$

$$Y_n=\begin{cases} Y_w*f_y^3 & f_x>0.2069 \\ Y_w*(f_y-0.1379)*0.1284 & \text{otherwise} \end{cases}$$

$$Z_n=\begin{cases} Z_w*f_Z^3 & f_z>0.2069 \\ Z_w*(f_z-0.1379)*0.1284 & \text{otherwise} \end{cases}$$

In the formulas, $f_y=(L+16)/116$, $$f_x=\frac{a}{500}+f_y,$$

$f_z=f_y-b/200$. The parameter a is the value a in the first Lab values, b is the value b in the first Lab values.

The color analyzer in the disclosure can adopt a CS2000 model or a CA310 model, etc.

Step S3, obtaining first output gray-scale values ($R_{1out}$, $G_{1out}$, $B_{1out}$) according to the first tristimulus values of the color n, the chromatic values of pure red, pure green and pure blue ($x_r$, $x_g$, $x_b$; $y_r$, $y_g$, $y_b$) in the first original value, and the tristimulus values of the pure white image ($X_w$, $Y_w$, $Z_w$).

Specifically, the first output gray-scale values ($R_{1out}$, $G_{1out}$, $B_{1out}$) are obtained by calculation as follows; an inverse matrix $M^{-1}$ is solved via the matrix M, a conversion matrix from the XYZ values to the RGB values is obtained:

$$\begin{bmatrix} R \\ G \\ B \end{bmatrix} = [M^{-1}] \begin{bmatrix} X \\ Y \\ Z \end{bmatrix}$$

In the formula, $R=R_{1out}$, $G=G_{1out}$, $B=B_{1out}$, $X=X_{1n}$, $Y=Y_{1n}$, $Z=Z_{1n}$.

The conversion from the RGB values to the XYZ values is achieved by calculation according to the following formula:

$$\begin{bmatrix} X \\ Y \\ Z \end{bmatrix} = [M] \begin{bmatrix} R \\ G \\ B \end{bmatrix}$$

M can be obtained according to following formulas:

$$[M] = \begin{bmatrix} S_r X_r & S_g X_g & S_b X_b \\ S_r Y_r & S_g Y_g & S_b Y_b \\ S_r Z_r & S_g Z_g & S_b Z_b \end{bmatrix}$$

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_w \\ Y_w \\ Z_w \end{bmatrix}$$

In the formulas above, $X_r=x_r/y_r$, $Y_r=1$, $Z_r=(1-x_r-y_r)/y_r$, $X_g=x_g/y_g$, $Y_g=1$, $Z_g=(1-x_g-y_g)/y_g$, $X_b=x_b/y_b$, $Y_b=1$, $Z_b=(1-x_b-y_b)/y_b$. As the color n can be regarded as a mixed color of red, green and blue three colors, color gamut showed by each of displays can be different, the R color point indicates a color point $x_r$, $y_r$ while the display shows pure red; G is $x_g$, $y_g$ during pure green; B is $x_b$, $y_b$ during pure blue.

Step S4, obtaining first input gray-scale values ($R_{1in}$, $G_{1in}$, $B_{1in}$) to be input to the display respectively according to the first output gray-scale values and the gamma value. The gamma value is 2.2.

The process of obtaining first input gray-scale values to be input to the display respectively according to the first output gray-scale values and the gamma value is achieved by calculation according to following formulas:

$$R_{1in}=255*R_{out}\hat{}(1/R_gamma);$$

$$G_{1in}=255*G_{out}\hat{}(1/G_gamma);$$

$$B_{1in}=255*B_{out}\hat{}(1/B_gamma).$$

R_gamma takes the gamma value corresponding to the R gray-scale in the first original value; G_gamma takes the gamma value corresponding to the G gray-scale in the first original value; B_gamma takes the gamma value corresponding to the B gray-scale in the first original value.

Step S5, obtaining second Lab values according to the first input gray-scale values ($R_{1in}$, $G_{1in}$, $B_{1in}$) and the tristimulus values of RGB three colors in the first original value.

The process of obtaining second Lab values according to the first input gray-scale values ($R_{1in}$, $G_{1in}$, $B_{1in}$) and the tristimulus values of RGB three colors in the first original value by converting from the XYZ values to the Lab values is achieved by calculation as follows.

First, the tristimulus values of RGB three colors are processed by mixing colors; second tristimulus values ($X_{2n}$, $Y_{2n}$, $Z_{2n}$) of the color n are obtained by calculation according to addition principle, specifically as follows.

$$X_n=X_R+X_G+X_B;$$

$$Y_n=Y_R+Y_G+Y_B;$$

$$Z_n=Z_R+Z_G+Z_B;$$

$$X_n=X_{2n}, Y_n=Y_{2n}, Z_n=Z_{2n}.$$

Second, after obtaining the second tristimulus values of the color n, the second Lab values are obtained by converting the XYZ values to the Lab values, specifically as follows.

$$L = 116 * f(Y/Y_w) - 16;$$

$$a = 500[f(X/X_w) - f(Y/Y_w)];$$

$$b = 200[f(Y/Y_w) - f(Z/Z_w)];$$

$$f(t) = \begin{cases} f^{1/3} & \text{if } t > \left(\frac{6}{29}\right)^3 \\ \frac{1}{3}\left(\frac{29}{6}\right)^2 t + \frac{4}{29} & \text{otherwise} \end{cases}$$

In the formulas above, t represents $X/X_w$, $Y/Y_w$; $Z/Z_w$; $X=X_{2n}$, $Y=Y_{2n}$, $Z=Z_{2n}$.

Step S6, comparing the first Lab values and the second Lab values, when the first Lab values are consistent with the second Lab values, outputting the first input gray-scale values to the measured display for display, which is step S7.

When the first Lab values are inconsistent with the second Lab values, step S8 will be processed, the step S8 is a correction.

Figure 2:
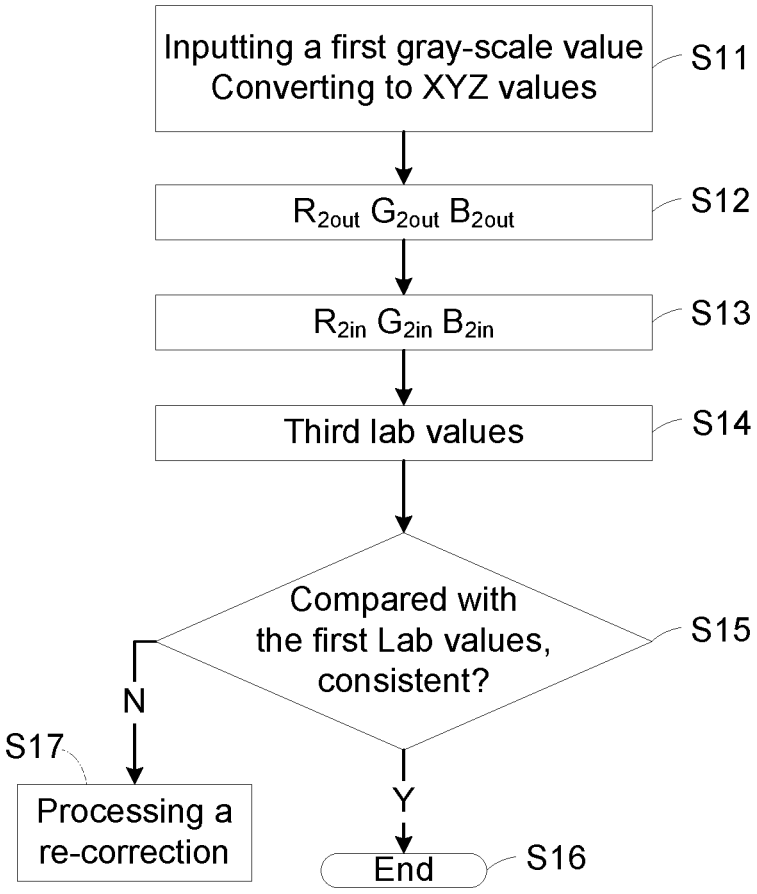
FIG. 2 is a flowchart of a correction according to the disclosure.

As shown in FIG. 2, the correction includes following steps.

Step S11, obtaining tristimulus values of $R_{1in}$, $G_{1in}$, $B_{1in}$ in the first input gray-scale values according to the first input gray-scale values ($R_{1in}$, $G_{1in}$, $B_{1in}$), subsequently obtaining third tristimulus values ($X_{3n}$, $Y_{3n}$, $Z_{3n}$) of the color n corresponding to the first input gray-scale values by calculation.

The process of obtaining the third tristimulus values by conversion of the first input gray-scale values is achieved by calculation as follows.

$$\begin{bmatrix} X \\ Y \\ Z \end{bmatrix} = [M] \begin{bmatrix} R \\ G \\ B \end{bmatrix}$$

M is obtained by following formulas:

$$[M] = \begin{bmatrix} S_r X_r & S_g X_g & S_b X_b \\ S_r Y_r & S_g Y_g & S_b Y_b \\ S_r Z_r & S_g Z_g & S_b Z_b \end{bmatrix}$$

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_w \\ Y_w \\ Z_w \end{bmatrix}$$

In the formulas above, $X_r=x_r/y_r$, $Y=1$, $Z_r=(1-x_r-y_r)/y_r$, $X_g=x_g/y_g$, $Y_g=1$, $Z_g=(1-x_g-y_g)/y_g$, $X_b=x_b/y_b$, $Y_b=1$, $Z_b=(1-$ $x_b-y_b)/y_b$. As the color n can be regarded as a mixed color of red, green and blue three colors, color gamut showed by each of displays can be different, the R color point indicates a color point $x_r$, $y_r$ while the display shows pure red; G is $x_g$, $y_g$ during pure green; B is $x_b$, $y_b$ during pure blue.

The third tristimulus values ($X_{3n}$, $Y_{3n}$, $Z_{3n}$) of the color n are obtained by processing the tristimulus values of RGB three colors in the color n by mixing colors, specifically obtained by calculation according to following formulas:

$$X=X_R+X_G+X_B;$$

$$Y=Y_R+Y_G+Y_B;$$

$$Z=Z_R+Z_G+Z_B.$$

In the formulas, $X_R$, $Y_R$ and $Z_R$ are tristimulus values of $R_{1in}$; $X_G$, $Y_G$ and $Z_G$ are tristimulus values of $G_{1in}$; $X_B$, $Y_B$ and $Z_B$ are tristimulus values of $B_{1in}$; $X=X_{3n}$, $Y=Y_{3n}$, $Z=Z_{3n}$.

Step S12, obtaining second output gray-scale values ($R_{2out}$, $G_{2out}$, $B_{2out}$) according to the third tristimulus values.

Specifically, an inverse matrix $M^{-1}$ is solved via the matrix M, a conversion matrix from the XYZ values to the RGB values is obtained, further obtaining the second output gray-scale values by calculation; specifically is $$\begin{bmatrix} R \\ G \\ B \end{bmatrix} = [M^{-1}] \begin{bmatrix} X \\ Y \\ Z \end{bmatrix}$$

In the formula, $R=R_{2out}$, $G=G_{2out}$, $B=B_{2out}$, $X=X_{2n}$, $Y=Y_{2n}$, $Z=Z_{2n}$.

The conversion from the RGB values to the XYZ values is achieved by calculation according to the following formula:

$$\begin{bmatrix} X \\ Y \\ Z \end{bmatrix} = [M] \begin{bmatrix} R \\ G \\ B \end{bmatrix}$$

M is obtained by following formulas:

$$[M] = \begin{bmatrix} S_rX_r & S_gX_g & S_bX_b \\ S_rY_r & S_gY_g & S_bY_b \\ S_rZ_r & S_gZ_g & S_bZ_b \end{bmatrix}$$

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_w \\ Y_w \\ Z_w \end{bmatrix}$$

In the formulas above, $X_r=x_r/y_r$, $Y_r=1$, $Z_r=(1-x_r-y_r)/y_r$, $X_g=x_g/y_g$, $Y_g=1$, $Z_g=(1-x_g-y_g)/y_g$, $X_b=x_b/y_b$, $Y_b=1$, $Z_b=(1-X_b-y_b)/y_b$. As the color n can be regarded as a mixed color of red, green and blue three colors, color gamut showed by each of displays can be different, the R color point indicates a color point $x_r$, $y_r$ while the display shows pure red; G is $x_g$, $y_g$ during pure green; B is $x_b$, $y_b$ during pure blue.

Step S13, obtaining second input gray-scale values ($R_{2in}$, $G_{2in}$, $B_{2in}$) according to the second output gray-scale values and the gamma value corresponding to the first input gray-scale values, outputting the second input gray-scale values.

$$R_{2in}=255*R_{2out}\hat{}(1/R\text{—gamma});$$

$$G_{2in}=255*G_{2out}\hat{}(1/G_\text{gamma});$$

$$G_{2in}=255*G_{2out}\hat{}(1/G_\text{gamma})$$

R_gamma takes the gamma value corresponding to the $R_{1in}$ gray-scale; G_gamma takes the gamma value corresponding to the $G_{1in}$ gray-scale; B_gamma takes the gamma value corresponding to the $B_{1in}$ gray-scale.

Step S14, obtaining third Lab values according to the second input gray-scale values.

The calculation specifically is first obtaining the RGB tristimulus values corresponding to the second input gray-scale values by calculation after obtaining the second input gray-scale values. The RGB tristimulus values are obtained by conversion of the RGB values, specifically calculated as follows:

$$\begin{bmatrix} X \\ Y \\ Z \end{bmatrix} = [M] \begin{bmatrix} R \\ G \\ B \end{bmatrix}$$

M is obtained by following formulas:

$$[M] = \begin{bmatrix} S_rX_r & S_gX_g & S_bX_b \\ S_rY_r & S_gY_g & S_bY_b \\ S_rZ_r & S_gZ_g & S_bZ_b \end{bmatrix}$$

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_w \\ Y_w \\ Z_w \end{bmatrix}$$

In the formulas above, $X_r=x_r/y_r$, $Y_r=1$, $Z_r=(1-x_r-y_r)/y_r$, $X_g=x_g/y_g$, $Y_g=1$, $Z_g=(1-x_g-y_g)/y_g$, $X_b=X_b/y_b$, $Y_b=1$, $Z_b=(1-x_b-y_b)/y_b$. As the color n can be regarded as a mixed color of red, green and blue three colors, color gamut showed by each of displays can be different, the R color point indicates a color point $x_r$, $y_r$ while the display shows pure red; G is $x_g$, $y_g$ during pure green; B is $x_b$, $y_b$ during pure blue.

Second, the third Lab values are obtained by conversion of the obtained RGB tristimulus values, which are specifically achieved as follows:

$$L = 116 * f(Y/Y_w) - 16;$$

$$a = 500[f(X/X_w) - f(Y/Y_w)];$$

$$b = 200[f(Y/Y_w) - f(Z/Z_w)];$$

$$f(t) = \begin{cases} f^{1/3} & \text{if } t > \left(\frac{6}{29}\right)^3 \\ \frac{1}{3}\left(\frac{29}{6}\right)^2 t + \frac{4}{29} & \text{otherwise} \end{cases}$$

In the formulas above, t represents $X/X_w$, $Y/Y_w$, $Z/Z_w$. X, Y and Z are the RGB tristimulus values.

Step S15, comparing the third Lab values and the first Lab values, if the third Lab values are consistent with the first Lab values, outputting the second input gray-scale values to the measured display for display, which is step S16.

When the third Lab values are inconsistent with the first Lab values, step S17 will be processed, the step S17 is a re-correction.

Figure 3:
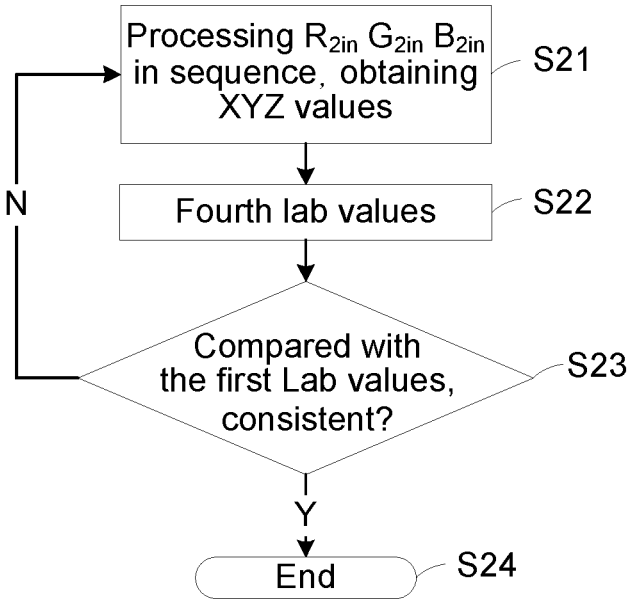
FIG. 3 is a flowchart of a re-correction according to the disclosure.

As shown in FIG. 3, the re-correction includes following steps.

Step S21, respectively processing the second input gray-scale values ($R_{2in}$, $G_{2in}$, $B_{2in}$) by ±1~10 simultaneously in sequence, meaning processing $R_{2in}$, $G_{2in}$ and $B_{2in}$ by ±1~10 simultaneously each time, the sequence is from 1 to obtain third input gray-scale values ($R_{3in}$, $G_{3in}$, $B_{3in}$), obtaining the RGB tristimulus values (the XYZ values) corresponding to a third gray-scale value after each process according to the third input gray-scale values.

The process of obtaining the RGB tristimulus values corresponding to the third gray-scale value by converting the RGB values to the XYZ values according to the third input gray-scale values is specifically achieved by calculation according to the following formula:

$$\begin{bmatrix} X \\ Y \\ Z \end{bmatrix} = [M] \begin{bmatrix} R \\ G \\ B \end{bmatrix}$$

M is obtained by following formulas:

$$[M] = \begin{bmatrix} S_r X_r & S_g X_g & S_b X_b \\ S_r Y_r & S_g Y_g & S_b Y_b \\ S_r Z_r & S_g Z_g & S_b Z_b \end{bmatrix}$$

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_w \\ Y_w \\ Z_w \end{bmatrix}$$

In the formulas above, $X_r=x_r/y_r$, $Y_r=1$, $Z_r=(1-x_r-y_r)/y_r$, $X_g=x_g/y_g$, $Y_g=1$, $Z_g=(1-x_g-y_g)/y_g$, $X_b=X_b/y_b$, $Y_b=1$, $Z_b=(1-x_b-y_b)/y_b$. As the color n can be regarded as a mixed color of red, green and blue three colors, color gamut showed by each of displays can be different, the R color point indicates a color point $x_r$, $y_r$ while the display shows pure red; G is $x_g$, $y_g$ during pure green; B is $x_b$, $y_b$ during pure blue.

Step S22, obtaining fourth Lab values according to the RGB tristimulus values.

The process of obtaining the fourth Lab values by conversion of the RGB tristimulus values is achieved by following formulas:

$$L = 116 * f(Y/Y_w) - 16;$$

$$a = 500[f(X/X_w) - f(Y/Y_w)];$$

$$b = 200[f(Y/Y_w) - f(Z/Z_w)];$$

$$f(t) = \begin{cases} f^{1/3} & \text{if } t > \left(\frac{6}{29}\right)^3 \\ \frac{1}{3}\left(\frac{29}{6}\right)^2 t + \frac{4}{29} & \text{otherwise} \end{cases}$$

In the formulas above, t represents $X/X_w$, $Y/Y_w$, $Z/Z_w$. X, Y and Z are the RGB tristimulus values.

Step S23, comparing the fourth Lab values and the first Lab values, if the fourth Lab values are consistent with the first Lab values, outputting the third input gray-scale values to the measured display for display, which is step S24. If the fourth Lab values are inconsistent with the first Lab values, the step S21 will be re-processed, the step S21 to the step S23 will be repeated until the fourth Lab values are consistent with the first Lab values.

Figure 4:
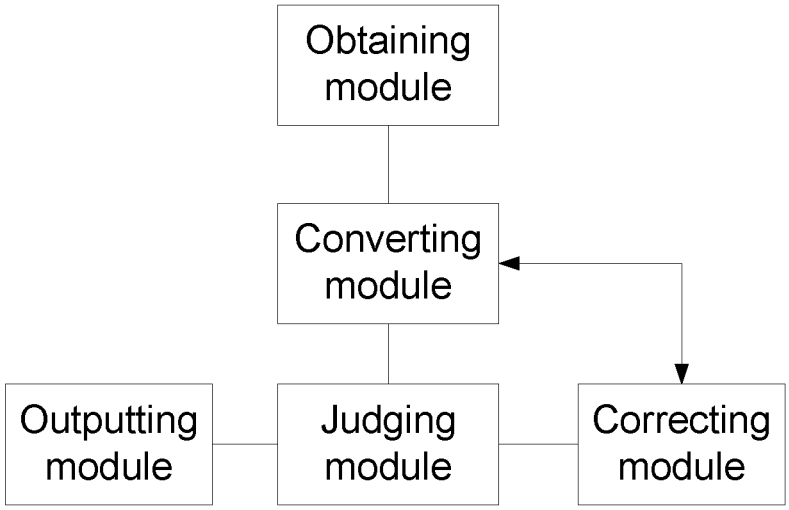
FIG. 4 is a block diagram of a system according to the disclosure.

As shown in FIG. 4, a system for generating images on a display of the disclosure includes an obtaining module, a converting module, a judging module, an outputting module and a correcting module.

The obtaining module is configured to obtain LCH values of a color n and obtain a first original value of a measured display, further sending the first original value to the converting module for conversion.

The converting module is configured to convert the LCH values of the color n to first Lab values according to the first original value; as well as processing conversion among XYZ values, RGB values, Lab values and a gray-scale value according to the first Lab values and the first original value.

The judging module is configured to compare the Lab values and the first Lab values. If the Lab values are consistent with the first Lab values, an output command will be sent to the outputting module. If the Lab values are inconsistent with the first Lab values, a correction command will be sent to the correcting module.

The outputting module is configured to output the corresponding gray-scale value to the measured display after receiving the output command.

The correcting module is configured to correct the gray-scale value once after receiving the correction command, and send the corrected gray-scale value to the converting module.

The correcting module is further configured to re-correct the gray-scale value, and send the corrected gray-scale value to the converting module.

The methods of correction and re-correction have been illustrated in detail, which will not be repeated.

In the following, the method for generating images on a display and the system for generating images on a display will be combined to briefly describe specific steps.

Step S1, the obtaining module obtains the LCH values (values of lightness (L), hue (H) and color (C)) of the color n, and obtain the first Lab values by calculation of the converting module.

Step S2, measuring a measured display by a color analyzer to obtain a first original value of the measured display, and sending the first original value to the obtaining module; obtaining first tristimulus values of the color n ($X_{1n}$, $Y_{1n}$, $Z_{1n}$) according to the tristimulus values of the pure white image as reference values and the first Lab values.

Step S3, the converting module obtains first output gray-scale values ($R_{1out}$, $G_{1out}$, $B_{1out}$) according to the first tristimulus values of the color n, the chromatic values of pure red, pure green and pure blue ($x_r$, $x_g$, $x_b$; $y_r$, $y_g$, $y_b$) in the first original value, and the tristimulus values of the pure white image ($X_w$, $Y_w$, $Z_w$).

Step S4, the converting module obtains first input gray-scale values ($R_{1in}$, $G_{1in}$, $B_{1in}$) to be input to the display respectively according to the first output gray-scale values and the gamma value.

Step S5, the converting module obtains the second Lab values according to the first input gray-scale values ($R_{1in}$, $G_{1in}$, $B_{1in}$) and the tristimulus values of RGB three colors in the first original value, and sends the second Lab values to the judging module.

Step S6, the judge module compares the first Lab values and the second Lab values. When the first Lab values are consistent with the second Lab values, step S7 will be processed, which is sending the first input gray-scale values to the measured display through the outputting module for display.

When the first Lab values are inconsistent with the second Lab values, step S8 will be processed, the step S8 is a correction.

The correction includes following steps.

Step S11, the converting module obtains tristimulus values of $R_{1in}$, $G_{1in}$, $B_{1in}$ in the first input gray-scale values according to the first input gray-scale values ($R_{1in}$, $G_{1in}$, $B_{1in}$), and subsequently obtains third tristimulus values ($X_{3n}$, $Y_{3n}$, $Z_{3n}$) of the color n corresponding to the first input gray-scale values by calculation.

Step S12, the converting module obtains second output gray-scale values ($R_{2out}$, $G_{2out}$, $B_{2out}$) according to the third tristimulus values and sends the second output gray-scale values to the correcting module.

Step S13, the correcting module obtains second input gray-scale values ($R_{2in}$, $G_{2in}$, $B_{2in}$) according to the second output gray-scale values and the gamma value corresponding to the first input gray-scale values, subsequently outputs the second input gray-scale values to the converting module.

Step S14, the converting module obtains third Lab values according to the second input gray-scale values, and sends the third Lab values to the judging module for judgement.

Step S15, the judging module compares the third Lab values and the first Lab values, if the third Lab values are consistent with the first values, step S16 will be processed, which is outputting the second input gray-scale values to the measured display through the outputting module for display.

When the third Lab values are inconsistent with the first Lab values, step S17 will be processed, the step S17 is a re-correction.

The re-correction includes following steps.

Step S21, the correcting module respectively processes the second input gray-scale values ($R_{2in}$, $G_{2in}$, $B_{2in}$) by ±1~10 in sequence to obtain third input gray-scale values ($R_{3in}$, $G_{3in}$, $B_{3in}$), the third input gray-scale values are sent to the converting module for calculation after each process, the RGB tristimulus values corresponding to the third gray-scale value are obtained by calculation.

Step S22, the converting module obtains fourth Lab values according to the RGB tristimulus values and sends the fourth Lab values to the judging module for judgement.

Step S23, the judging module compares the fourth Lab values and the first Lab values, if the fourth Lab values are consistent with the first Lab values, the judging module outputs the third input gray-scale values to the measured display through the outputting module for display, which is step S24. If the fourth Lab values are inconsistent with the first Lab values, the step S21 will be re-processed, the step S21 to the step S23 will be repeated until the fourth Lab values are consistent with the first Lab values.

Although the disclosure is illustrated with reference to specific embodiments, a person skilled in the art should understand that various modifications on forms and details can be achieved within the spirit and scope of the disclosure limited by the claims and the counterpart.

What is claimed is:

1. A method for generating images on a display by converting parameters used in three different color systems, which comprises a CIELab color system, a CIE1931-XYZ standard color system and a CIE1931 color system, comprising following steps:

step S1, obtaining LCH values of a color n, wherein the LCH values of the color n comprise a lightness value L, a hue value H and a color value C of the color n, and obtaining first Lab values by converting the LCH values of the color n to the first Lab values used in the CIELab color system, wherein the first Lab values comprises a first parameter, a second parameter a and a third parameter b, and the first parameter, the second parameter a and the third parameter b are calculated by following formulas:

the first parameter=$L$;

the second parameter $a=C\cos(H)$; and the third parameter $b=C\sin(H)$;

step S2, measuring a measured display by a color analyzer to obtain a first original value of the measured display, the first original value comprising tristimulus values of an R, G, B, W four colors full gray-scale, a gamma value of R, G, B, W four colors, tristimulus values of a pure white image, and chromatic values of pure red, pure green and pure blue; obtaining first tristimulus values of the color n by referring to the tristimulus values of the pure white image so that the first Lab values used in the CIELab color system are converted into the first tristimulus values used in the CIE1931-XYZ standard color system;

step S3, converting the first tristimulus values used in the CIE1931-XYZ standard color system into first output gray-scale values of RGB three colors used in the CIE1931 color system according to the first tristimulus values of the color n, the chromatic values of pure red, pure green and pure blue in the first original value, and the tristimulus values of the pure white image;

step S4, obtaining first input gray-scale values to be input to the display respectively according to the first output gray-scale values and the gamma value of RGB three colors;

step S5, obtaining second Lab values used in the CIELab color system according to the first input gray-scale values and the tristimulus values of RGB three colors in the first original value;

step S6, comparing the first Lab values and the second Lab values, when the first Lab values are consistent with the second Lab values, outputting the first input gray-scale values to the measured display for display, which is step S7.

2. The method for generating images on a display according to claim 1, wherein a process of obtaining the second Lab values used in the CIELab color system according to the first input gray-scale values and the tristimulus values of RGB three colors in the first original value in the step S5 is achieved by: processing the tristimulus values of the RGB three colors by mixing colors; obtaining second tristimulus values of the color n; after obtaining the second tristimulus values of the color n, converting the second tristimulus values used in the CIE1931-XYZ standard color system into the second Lab values used in the CIELab color system.

3. The method for generating images on a display according to claim 2, wherein in the step S6, when the first Lab values are not consistent with the second Lab values, step S8 is processed to perform following steps:

step S11, obtaining tristimulus values of $R_{1in}$, $G_{1in}$, $B_{1in}$ in the first input gray-scale value according to the first input gray-scale values, subsequently obtaining third tristimulus values of the color n corresponding to the first input gray-scale values by converting the first input gray-scale values used in the CIE1931 color system into the third tristimulus values of the color n used in the CIE1931-XYZ standard color system;

step S12, obtaining second output gray-scale values by converting the third tristimulus values of the color n used in the CIE1931-XYZ standard color system into the second output gray-scale values used in the CIE1931 color system;

step S13, obtaining second input gray-scale values according to the second output gray-scale values and the gamma value corresponding to the first input gray-scale values, and outputting the second input gray-scale values;

step S14, obtaining third Lab values according to the second input gray-scale values;

step S15, comparing the third Lab values and the first Lab values, if the third Lab values are consistent with the first values, outputting the second input gray-scale values to the measured display for display, which is step S16.

4. The method for generating images on a display according to claim 3, wherein obtaining the third Lab values according to the second input gray-scale values is achieved by: converting the second input gray-scale values to the RGB tristimulus values corresponding to the second input gray-scale values after obtaining the second input gray-scale values; and converting the obtained RGB tristimulus values used in the CIE1931 color system into the third Lab values used in the CIELab color system.

5. The method for generating images on a display according to claim 1, wherein in the step S6, when the first Lab values are not consistent with the second Lab values, step S8 is processed to perform following steps:

step S11, obtaining tristimulus values of $R_{1in}$, $G_{1in}$, $B_{1in}$ in the first input gray-scale value according to the first input gray-scale values, subsequently obtaining third tristimulus values of the color n corresponding to the first input gray-scale values by converting the first input gray-scale values used in the CIE1931 color system into the third tristimulus values of the color n used in the CIE1931-XYZ standard color system;

step S12, obtaining second output gray-scale values by converting the third tristimulus values of the color n used in the CIE1931-XYZ standard color system into the second output gray-scale values used in the CIE1931 color system;

step S13, obtaining second input gray-scale values according to the second output gray-scale values and the gamma value corresponding to the first input gray-scale values, and outputting the second input gray-scale values;

step S14, obtaining third Lab values according to the second input gray-scale values;

step S15, comparing the third Lab values and the first Lab values, if the third Lab values are consistent with the first values, outputting the second input gray-scale values to the measured display for display, which is step S16.

6. The method for generating images on a display according to claim 5, wherein obtaining the third Lab values according to the second input gray-scale values is achieved by: converting the second input gray-scale values to the RGB tristimulus values corresponding to the second input gray-scale values after obtaining the second input gray-scale values; and converting the obtained RGB tristimulus values used in the CIE1931 color system into the third Lab values used in the CIELab color system.

7. The method for generating images on a display according to claim 6, wherein in the step S15, when the third Lab values are inconsistent with the first Lab values, step S17 is processed to perform following steps:

step S21, respectively processing the second input gray-scale values by ±1~10 in sequence to obtain third input gray-scale values; obtaining the RGB tristimulus values corresponding to each of the third input gray-scale values after each process; and converting the first input gray-scale values used in the CIE1931 color system into the third tristimulus values of the color n used in the CIE1931-XYZ standard color system;

step S22, converting the RGB tristimulus values corresponding to each of the third input gray-scale values into corresponded fourth Lab values used in the CIELab color system;

step S23, comparing the fourth Lab values and the first Lab values, if the fourth Lab values are consistent with the first Lab values, outputting the third input gray-scale values corresponding to the compared fourth Lab values to the measured display for display, which is step S24.

8. The method for generating images on a display according to claim 7, wherein in the step S23, the fourth Lab values and the first Lab values are compared, if the fourth Lab values are inconsistent with the first Lab values, the step S21 is re-processed, the step S21 to the step S23 are repeated until the fourth Lab values are consistent with the first Lab values.

* * * * *